US009057161B2

(12) United States Patent
Berning et al.

(10) Patent No.: US 9,057,161 B2
(45) Date of Patent: Jun. 16, 2015

(54) ROAD CONSTRUCTION MACHINE, AS WELL AS METHOD FOR CONTROLLING THE DISTANCE OF A ROAD CONSTRUCTION MACHINE MOVED ON A GROUND SURFACE

(71) Applicant: Wirtgen GmbH, Windhagen (DE)

(72) Inventors: Christian Berning, Brühl (DE); Rene Müller, Vettelschoss (DE); Thomas Schmidt, Koblenz (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/183,682

(22) Filed: Feb. 19, 2014

(65) Prior Publication Data

US 2014/0199120 A1 Jul. 17, 2014

Related U.S. Application Data

(62) Division of application No. 13/109,078, filed on May 17, 2011, now Pat. No. 8,672,581.

(30) Foreign Application Priority Data

Jun. 2, 2010 (DE) ..... 102010022467

(51) Int. Cl.

| | |
|---|---|
| ***E01C 23/07*** | (2006.01) |
| ***G06F 7/70*** | (2006.01) |
| ***E21C 35/08*** | (2006.01) |
| ***E21C 25/00*** | (2006.01) |
| ***E01C 21/00*** | (2006.01) |
| ***E01C 19/00*** | (2006.01) |

(52) U.S. Cl.
CPC ..... *E01C 21/00* (2013.01); *E01C 19/004* (2013.01)

(58) Field of Classification Search
USPC ..... 404/84.05, 84.1, 118; 299/39.6; 701/50; 180/41; 280/43, 6.157
See application file for complete search history.

(56) References Cited

U.S. PATENT DOCUMENTS

| | | | | |
|---|---|---|---|---|
| 6,530,720 | B1 * | 3/2003 | Green | 404/84.1 |
| 6,916,070 | B2 | 7/2005 | Sehr | |
| 2008/0152428 | A1 | 6/2008 | Berning et al. | |

FOREIGN PATENT DOCUMENTS

| | | | |
|---|---|---|---|
| DE | 10060903 | A1 | 7/2002 |
| DE | 102006062129 | A1 | 7/2008 |

*Primary Examiner* — Abigail A Risic
(74) *Attorney, Agent, or Firm* — Lucian Wayne Beavers; Patterson Intellectual Property Law, P.C.

(57) ABSTRACT

A road construction machine comprising height adjustment devices which adjust the position of the plane of the machine frame in accordance with control signals, where the leveling device measures the distance of the ground surface to the machine frame and controls the height adjustment devices so the machine frame is movable at an adjusted orthogonal distance to the surface; a transmitter is arranged at the machine frame in a rigid fashion, and a receiver is movable, parallel to and synchronously with the machine frame, or vice versa, where the transmitter emits a measuring beam representative of a reference plane, the measuring beam being detectable by the receiver and representing either a plane extending parallel to the machine frame or a plane extending parallel to the ground surface, where the current distance of the machine frame to the current reference location is measurable from the detected position of the reference plane.

29 Claims, 3 Drawing Sheets

Figure 1:
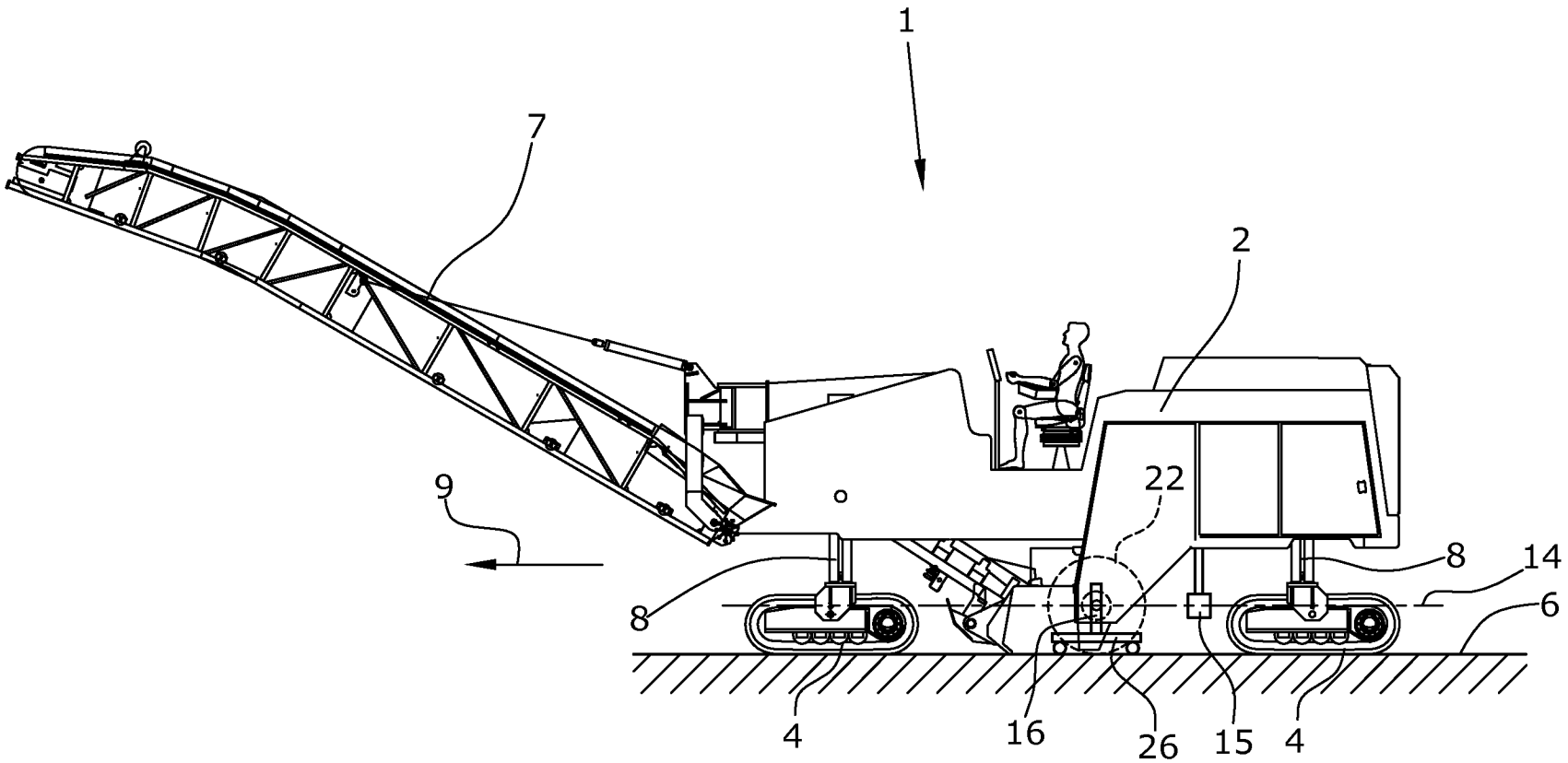

ROAD CONSTRUCTION MACHINE, AS WELL AS METHOD FOR CONTROLLING THE DISTANCE OF A ROAD CONSTRUCTION MACHINE MOVED ON A GROUND SURFACE

The invention relates to a road construction machine as well as a method for controlling the distance of the machine frame of a road construction machine from a ground surface.

Such road construction machines, in particular road milling machines or recyclers, require a level reference for working a ground surface or a road surface in order to not identically copy the existing irregularities of the ground surface when working the ground surface or road surface. On the contrary, irregularities and corrugations are to be levelled out to the greatest possible extent by the working process. Without a reference value for the height adjustment of the machine frame or the working tool, the working result would, in the worst case, reproduce all of the irregularities and corrugations as well as inclinations, which would pose greater difficulties to machines following behind, such as asphalting machines or compaction rollers, to create an even, homogeneously compacted road pavement.

The road construction machine comprises a machine frame which is carried by a chassis in a single plane, where the chassis moves on a ground surface or road surface. The chassis carries the machine frame via at least three lifting columns (or, with small milling machines, only at least two lifting columns at the rear axle), which form a height adjustment device for the machine frame and which adjust the plane of the machine frame in accordance with control signals of a levelling device also with regard to a cross slope. The levelling device controls the distance of the machine frame to the ground surface currently driven over. It is already known for this purpose that the ground surface is scanned via side plates arranged at the side next to a working drum, or that a wire is tensioned along the driving route of the road construction machine, which can be scanned from the machine.

With machines comprising working drums rigidly mounted in the machine frame, the distance may be measured relative to the machine frame.

With machines in which the working drum is adjustable relative to the machine frame, additional consideration must be given to the distance of the working drum from the machine frame.

In case of a road surface, an advantageous reference location is frequently to be found in the center of the pavement as this is where the pavement shows hardly any damages, deformations or other irregularities.

It is already known in this regard to move a carriage next to the road construction machine along the center of the pavement, said carriage being connected to the road construction machine by means of a telescope. The telescope is designed to adjust a different lateral distance of the carriage. A displacement transducer is mounted at the free end of the telescopic rod, said displacement transducer detecting the distance of the telescopic rod relative to the ground surface or road surface. This solution using a telescope offers the advantage that, when working a second working or milling cut, the same reference location at the side of or on the road centerline can be used.

It is of disadvantage in this solution that, due to the widely projecting telescopic arm, a relevant deformation of the telescopic arm cannot be excluded so that the distance measurement could be distorted as a result.

It is the object of the invention to create a road construction machine of the type first mentioned above, or a method respectively, to control the distance of a road construction machine from a ground surface in which the distance measurement can be performed with increased accuracy and with higher reproducibility, as well as with lower equipment-related complexity.

As a result of the fact that a measuring beam representing a reference plane is directed towards a receiver arranged at a distance from the transmitter, the distance from the ground surface to the reference plane can be measured with high accuracy and reproducibility, without a mechanism which moves the receiver or the transmitter synchronously with the road construction machine being able to influence the measuring result. The measuring device can be calibrated prior to commencing work.

The distance signal detected can thus directly control the distance of the machine frame to the ground surface via the levelling device.

In this arrangement, it is provided that the transmitter or the receiver is movable, at a specifiable distance at the side of the machine frame, along a progressing reference location on the ground surface.

The specifiable lateral distance from the road construction machine, or the machine frame respectively, is designed to determine the position of the reference location, for instance, along a road centerline, said reference location being moved along with the road construction machine. In the event of several working cuts, it is possible to perform scanning by the receiver using the same reference location that was the basis for working the first working cut.

It is preferably provided that a working drum is mounted in the machine frame, and that the transmitter or the receiver is arranged in a plane which extends essentially orthogonal to the reference plane, and which also extends through or nearby the rotating axis of the milling drum.

Arranging the transmitter or the receiver in a common, essentially vertical plane with the axis of the working drum enables the distance value measured to be used, in the form of a measuring signal without conversion, by the levelling device to control the distance of the machine frame and therefore of the working drum.

When, in relation to the axis of rotation of the working drum, the reference location lies in front of or behind the axis of rotation in direction of travel, a conversion is required which takes into account an inclination of the machine frame in longitudinal direction relative to the direction of travel.

It is preferably provided that the transmitter or the receiver is arranged on a carriage which is movable, synchronously with the machine frame, in the direction of travel along the reference location on the ground surface.

In this arrangement, the transmitter or the receiver is arranged on a carriage preferably provided with rollers, which travels over the reference location.

In this arrangement, the receiver extends across a sufficient height in relation to the reference plane in order to be able to detect the position of the reference plane.

The transmitter or the receiver is arranged on a carriage which is attached to the machine frame in an articulated fashion via a coupling element telescoping laterally relative to the machine frame. For example, at least two articulations arranged at a distance to each other may be provided, the axes of which run parallel to the direction of travel or parallel to the axis of the milling drum.

The receiver may comprise several sensors arranged orthogonal to the ground surface at the reference location or to the machine frame, said sensors being able to measure the position of the reference plane. The sensors are arranged on a carriage, for example, in such a fashion that they extend orthogonal to the ground surface on which the carriage is travelling. Alternatively, sensors arranged at the machine frame extend orthogonal to a plane extending parallel to the machine frame. In this arrangement, the sensors are strung to one another, with the distance of the sensors determining the resolution of the measurement. The sensors are light-sensitive sensors, for example, which are able to detect a reference plane formed by light.

The receiver may also comprise several sensors extending orthogonal and parallel to the respective planes, said sensors measuring the position of the reference plane in terms of distance and slope.

It is thus possible, for example, by means of arranging several sensors in a plane extending parallel to the ground surface, to measure not only the distance but also the current slope of the reference plane relative to the current reference location. In so doing, it is not only possible to control the distance of the machine frame and thus of the working tool at the height of the working drum but to additionally also control the height adjustment devices in such a fashion that the machine frame extends parallel to the current reference location.

It is preferably provided that the transmitter emits measuring beams, in the form of coherent light, in a linear fashion, in a sector-shaped fashion or under an angle of up to 360 degrees, and that the reference plane is formed by said light which is detectable by the receiver.

A particularly preferred embodiment provides that a transmitter at the machine frame defines a reference plane which extends parallel to the machine frame, that a receiver extending in an essentially orthogonal direction to the ground surface at the reference location to above the reference plane is movable parallel to and synchronously with the machine frame, said receiver detecting the distance of the reference plane to the current reference location.

It is preferably provided that the receiver comprises a transparent housing which extends to above the reference plane, said housing containing the sensors, in a linear arrangement, orthogonal to the ground surface at the reference location.

It may be provided that several sensors are arranged in a plane extending parallel to the ground surface at the current reference location.

A preferred embodiment provides that the reference location of the ground surface is located along a road centerline.

The transmitter is preferably arranged on that side of the machine frame facing the reference location.

It may be provided that the distance of the supporting means of the carriage on the ground surface along the reference location is chosen so as to level out any irregularities of the reference location in the direction of travel. The carriage carrying the receiver is preferably provided with a large wheelbase of the carriage wheels in longitudinal direction, that is, in the direction of travel. Other supporting means may also be provided in lieu of or in addition to the carriage wheels, such as skids which are arranged at the sides of the carriage and which are significantly longer than the wheelbase of the carriage wheels. It is understood that the carriage may also comprise two carriage wheels per axle arranged next to one another.

Alternatively, the carriage may also be carried by the skids, or the carriage wheels may be arranged at the ends of the skids. In a further alternative, several carriage wheels are arranged, in the direction of travel, at the carriage or at the skids, for example, at a low distance to each other.

In a method for controlling the distance of the machine frame of a road construction machine moved on a ground surface to a reference location of the ground surface next to the road construction machine in accordance with control signals of a levelling device, where the distance of the machine frame to the ground surface is measured and the machine frame, when travelling over the ground surface, is maintained at an adjustable orthogonal distance to the reference location of the ground surface, it is provided that a reference plane extending parallel to the machine frame or to the ground surface at a reference location is represented by at least one measuring beam of a transmitter, where the reference plane is detected by a receiver running essentially orthogonal to the other plane extending parallel to the ground surface at a reference location or to the machine frame, thus measuring the distance of the axis of the milling drum to the ground surface at the reference location.

Specifically, a reference plane extending parallel to the machine frame can be defined, and a receiver extending in an essentially orthogonal direction to the ground surface at the reference location to above the reference plane can be moved, at a specifiable distance at the side of the machine frame, along the reference location on the ground surface, as well as parallel to and synchronously with the machine frame, said receiver detecting the distance of the current reference location of the ground surface to the reference plane.

In this arrangement, it is preferably provided that, when the road construction machine is started up, the current position of the reference plane is saved as default value, starting from which any deviations in the distance of the reference plane to the current reference location are measured.

In the following, embodiments of the invention are explained in more detail with reference to the drawings.

Figure 2:
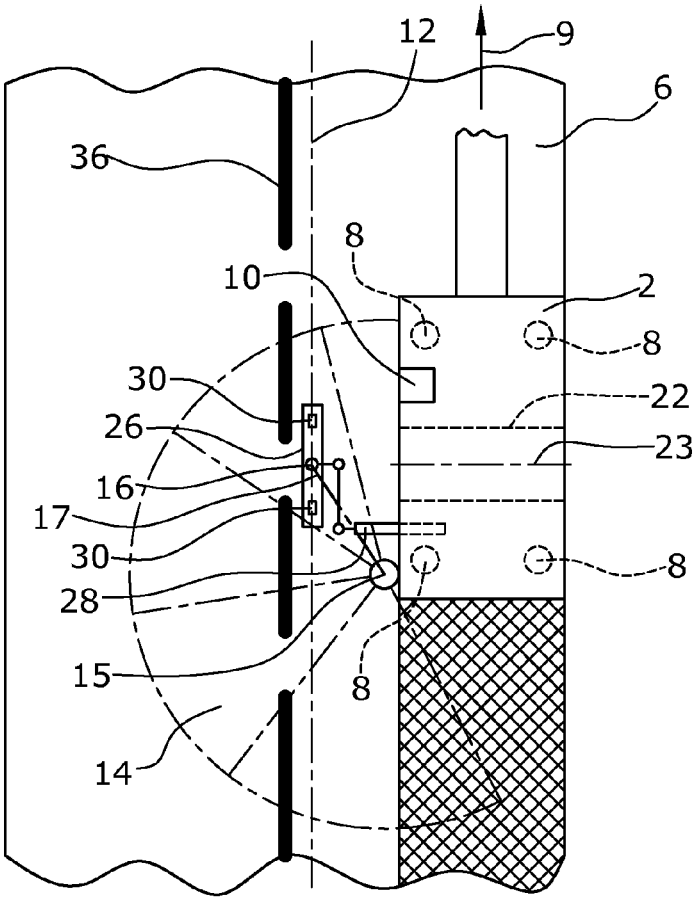
Figure 3:
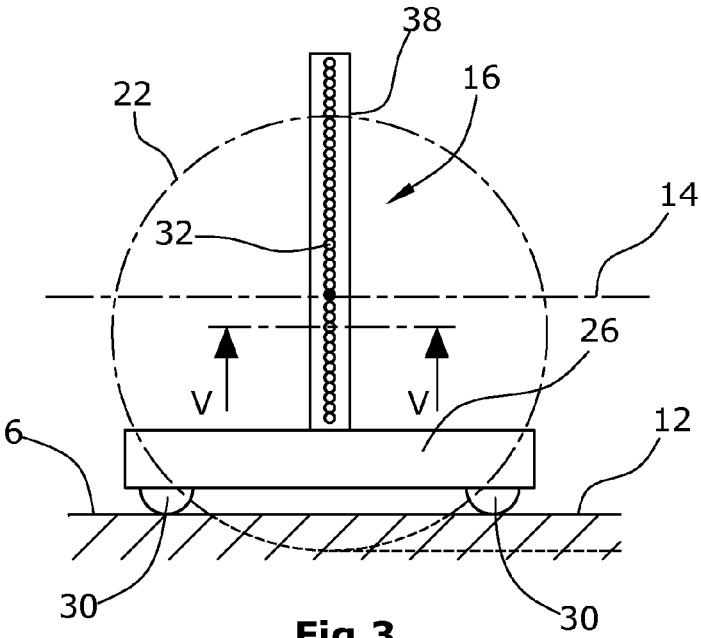
Figure 4:
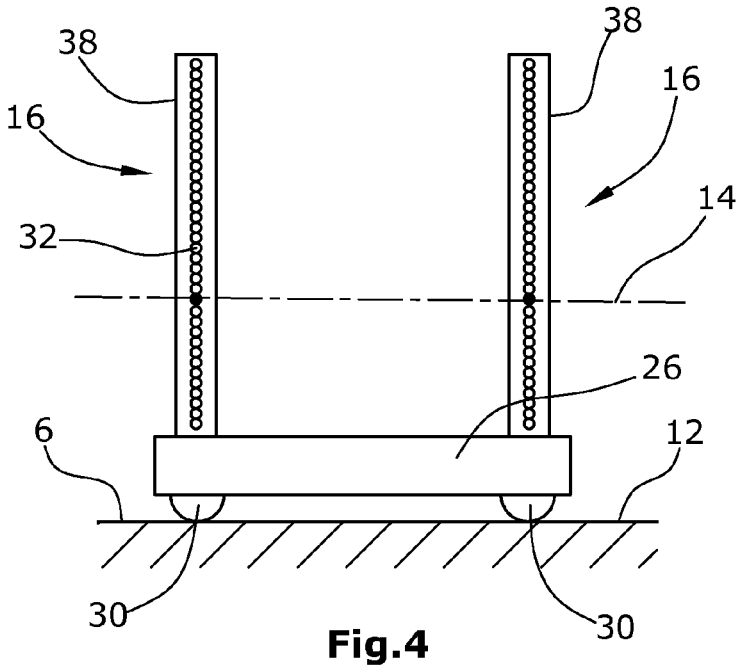
Figure 5:
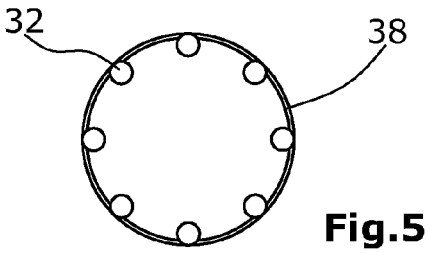

The following is shown:

FIG. 1 a road construction machine, in particular a road milling machine,

FIG. 2 a schematic top view of a working situation on a road surface,

FIG. 3 the receiver according to the invention on a carriage,

FIG. 4 an alternative embodiment with two receivers,

FIG. 5 a section along the line V-V in FIGS. 3, and

Figure 6:
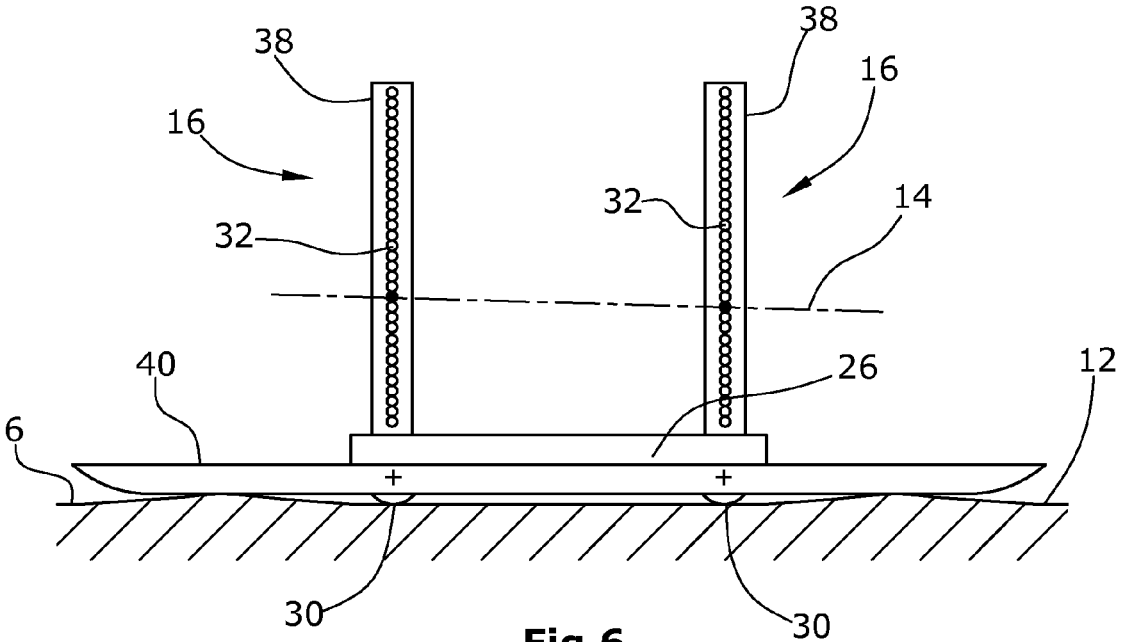

FIG. 6 an additional alternative embodiment which shows the arrangement of skids.

FIG. 1 shows a road construction machine 1 using a road milling machine as an example. The road construction machine 1 comprises a machine frame 2 which is carried by a chassis 4 consisting of, for example, crawler track units, said chassis 4 being connected to the machine frame 2 via at least three height adjustment devices 8 designed as lifting columns. As can be seen from FIG. 2, the embodiment provides four lifting columns which can be used to move the machine frame 2 into a specified plane that extends preferably parallel to the ground surface 6 on which the crawler track units of the chassis 4 rest. With a horizontal ground surface 6, the machine frame 2 would normally be aligned horizontally.

The road milling machine shown in FIG. 1 comprises a working drum 22 between the crawler track units of the chassis 4.

In the case of a road milling machine, the working drum 22 is a milling drum. Other designs of a road construction machine may also feature the milling drum, for example, at the level of the rear crawler track units or wheels of the chassis 4. The transport devices for transporting the milled ground material may, in the same way, be arranged at the front end 7 or at the rear end of the road construction machine 1.

The road construction machine 1 comprises a levelling device 10 which receives a distance signal representative of the distance between the machine frame 2 and the ground surface 6, and which controls the height adjustment devices 8 in accordance with said distance signal in such a fashion that a specified distance of the machine frame 2 and thus also of the working drum 22 to the ground surface is maintained. To this effect, the levelling device 10 comprises an input and operating device on the operator's platform, as well as a transmitter 15 which emits a measuring beam 17 that is representative of a plane extending parallel to the plane of the machine frame 2. In this arrangement, the measuring beam 17 is directed towards a receiver 16 which scans the ground surface 6 along a reference location 12 in such a fashion that the distance of the reference plane 14, which extends parallel to the machine frame 2, to the reference location 12 can be detected by means of sensors 32 that are sensitive to the measuring beam 17.

The transmitter 15 may emit a single measuring beam 17, may emit several measuring beams 17 arranged next to one another and located in the reference plane 14, or may emit measuring beams 17 in a sector-shaped fashion in a single plane to up to an emission of up to 360 degrees. The transmitter 15 may be attached in any position on the machine frame 2 that allows a free line of sight to the receiver 16, and is therefore preferably attached to the machine frame 2 on that side of the road construction machine 1 facing the reference location 12.

The receiver 16 is preferably moved along the reference location 12 on a carriage 26, said carriage 26 being connected to the machine frame 2 in an articulated fashion via a coupling element 28 telescoping laterally at the side of the machine frame 2.

To this effect, at least two articulations are provided between the carriage 26 and the machine frame 2, the axes of which extend preferably parallel to the direction of travel 9 or parallel to the milling drum axis 23. In order to be able to also measure differences in slope, a ball-and-socket joint may be provided, for example, between the telescopic rod and the carriage 26, in which case it must then be ensured that the carriage follows the reference location 12.

The telescoping coupling element 28 is designed to enable a variable lateral distance of the carriage 26 to the machine frame 2. If the road construction machine 1 needs to be driven over the ground surface 6 in several cuts in case of wide roads, the telescoping feature enables the same reference location 12 to be selected for each cut.

As can be seen from FIG. 2, the reference location 12 may extend near the center of a carriageway width as this location shows the least damages, deformations or corrugations of the ground surface 6.

FIG. 2 shows an omnidirectional emission by the transmitter 15. Such an emission of the measuring beams 17 to define a reference plane 14 is of advantage, for example, in the event that several receivers 16 are provided, for instance, at the front and at the rear end of the road construction machine 1. Emission of the measuring beams 17 in a sector-like fashion would already be sufficient to enable a distance measurement to be performed even at different lateral distances of the reference location 12 to the machine frame 2.

In extreme cases, a single measuring beam 17 of, for example, a laser diode is sufficient if the measuring beam 17 can be directed towards the receiver 16.

FIG. 3 shows an embodiment of a receiver 16 which is arranged on a carriage 26 that is moved on carriage rollers 30 along the reference location 12 on the ground surface 6. The arrangement of the sensors 32 is depicted schematically and is, in the most simple case, a linear arrangement of the sensors 32 orthogonal to the reference location 12 of the ground surface 6. The reference plane 14 is indicated as a dashed line, with the sensor 32 receiving the measuring signal being depicted as a black dot. It is understood that the smaller the distance between the individual sensors 32, the better will be the resolution.

In the background, the working drum 22 is depicted schematically as a circle to indicate that a preferred position of the receiver 16 runs in the plane extending orthogonal to the ground surface 6 through the milling drum axis 23.

As has already been explained, two carriages 26 may also be provided at the front and at the rear end of the road construction machine 1. In this case, it is possible to also measure the longitudinal slope of the reference plane 14. To control the distance of the machine frame 2 at the height of the milling drum axis 23, the levelling device 10 must perform a conversion that results from the geometric data of the road construction machine 1.

FIG. 4 shows a second embodiment in which two receivers 16 are arranged at a distance to each other on a carriage 26. The reference plane 14 is depicted with a longitudinal slope which can be measured by means of the sensors 32 of the two receivers 16.

FIG. 5 shows a cross-section of the embodiment in FIG. 3, from which a possible arrangement of the sensors 32 in a ground-parallel arrangement is apparent. In the most simple embodiment, only one sensor 32 is located in a ground-parallel plane in the housing 38 of the receiver 16, said housing 38 consisting, for example, of acrylic glass. Alternatively, several sensors 32 may, however, be arranged in a single plane. FIG. 5 shows, for instance, eight sensors 32.

Provided that no slopes are to be measured with the arrangement of the sensors 32, only that sensor 32 in the plane which receives the strongest signal may be activated at any one time. Especially with larger dimensions of the housing 38, which is of circular shape only by way of example, the circular arrangement of the sensors 32 could, however, also be used to measure a slope of the reference plane 14 both as a longitudinal and as a cross slope of the machine frame 2 of the road construction machine 1.

A precondition in this arrangement is that the carriage 26 is maintained parallel to the machine frame 2 but is otherwise coupled to the machine frame 2 in an articulated fashion, and namely, in an articulated fashion about an axis extending parallel to the milling drum axis 23, and in an articulated fashion with regard to an axis extending orthogonal to the milling drum axis 23 and parallel in the direction of travel 9.

FIG. 6, finally, shows a further embodiment that is provided with two receivers 16 but may, of course, also comprise only one receiver 16. This embodiment provides a skid 40 on at least one side of the carriage 26, said skid 40 being of such a length that it enables improved levelling out of any longitudinal corrugations of the ground surface at the reference location 12.

In an additional embodiment not shown, the carriage wheels 30 may also be arranged at the ends of the skids 40.

The embodiments shown show the transmitter 15 arranged at the machine frame and the receiver 16 arranged on a movable carriage 26. It is understood that a reversed arrangement is also possible, namely, the transmitter 15 on the movable carriage 26, and the receiver at the machine frame. In this case, one or several measuring beams 17 would be emitted, at a specified height, from the carriage 26 towards the machine frame, with the sensors 32 of the receiver 16 being arranged, orthogonal to the plane extending parallel to the machine frame 2, in suitable positions at the sides of the construction machine 1.

When defining a reference plane 14 that is emitted in all directions or is at least emitted in the direction of the road construction machine 1, there is also the possibility to arrange two receiving devices at the front and at the rear end of the road construction machine 1, which can then be used, for example, to also detect the longitudinal slope of the road construction machine. If, in addition to the sensors 32 arranged orthogonal to the plane of the machine frame 2, the receiving device also comprises such sensors arranged parallel to the machine frame 2, then it is also possible to measure a cross slope of the machine frame 2 in relation to the reference location 12 of the ground surface 6.

It should be noted in this regard that the road construction machine 1 is mostly operated at a specified cross slope in order to ensure the drainage of water on a road surface to be newly built.

The invention claimed is:

1. A method of controlling a height of a machine frame of a road construction machine relative to a ground surface as the road construction machine moves over the ground surface, comprising:

(a) transmitting with a transmitter at least one measuring beam to define a reference plane, the reference plane extending parallel to one of the machine frame and the ground surface at a reference location;

(b) detecting the at least one measuring beam with a receiver associated with the other of the machine frame and the ground surface at the reference location, and thereby measuring the height of the machine frame relative to the reference location on the ground surface, one of the transmitter and receiver being rigidly connected to the machine frame, wherein both the transmitter and the receiver are moving with the road construction machine over the ground surface during steps (a) and (b); and (c) controlling the height of the machine frame relative to the reference location on the ground surface in response to the height measured in step (b).

2. A method of controlling a height of a machine frame of a road construction machine relative to a ground surface as the road construction machine moves over the ground surface, comprising:

(a) transmitting with a transmitter at least one measuring beam to define a reference plane, the reference plane extending parallel to one of the machine frame and the ground surface at a reference location;

(b) detecting the at least one measuring beam with a receiver associated with the other of the machine frame and the round surface at the reference location, and thereby measuring the height of the machine frame relative to the reference location on the ground surface, one of the transmitter and receiver being rigidly connected to the machine frame; and (c) controlling the height of the machine frame relative to the reference location on the ground surface in response to the height measured in step (b); wherein in step (a), the transmitter is rigidly connected to the machine frame and the reference plane is defined parallel to the machine frame;

in step (b), the receiver extends substantially orthogonal to the reference plane at the reference location; and further comprising, as the road construction machine moves over the ground surface, moving the receiver at a selectable distance laterally from a side of the machine frame, as well as parallel to and synchronously with the machine frame.

3. A method of controlling a height of a machine frame of a road construction machine relative to a ground surface as the road construction machine moves over the ground surface, comprising:

(a) transmitting with a transmitter at least one measuring beam to define a reference plane, the reference plane extending parallel to one of the machine frame and the ground surface at a reference location;

(b) detecting the at least one measuring beam with a receiver associated with the other of the machine frame and the round surface at the reference location, and thereby measuring the height of the machine frame relative to the reference location on the ground surface, one of the transmitter and receiver being rigidly connected to the machine frame;

(c) controlling the height of the machine frame relative to the reference location on the ground surface in response to the height measured in step (b); and (d) when starting up the road construction machine, saving a current position of the reference plane as a default value from which default value any deviations in the distance of the reference plane to a current reference location on the ground surface are measured.

4. The method of claim 1, wherein:

in step (a) the reference plane extends parallel to the ground surface at the reference location; and in step (b) the receiver is rigidly connected to the machine frame.

5. The method of claim 1, further comprising:

moving the other of the transmitter and receiver at a specifiable distance from a side of the machine frame, on the ground surface.

6. A method of controlling a height of a machine frame of a road construction machine relative to a ground surface as the road construction machine moves over the ground surface, comprising:

(a) transmitting with a transmitter at least one measuring beam to define a reference plane, the reference plane extending parallel to one of the machine frame and the ground surface at a reference location;

(b) detecting the at least one measuring beam with a receiver associated with the other of the machine frame and the round surface at the reference location, and thereby measuring the height of the machine frame relative to the reference location on the ground surface, one of the transmitter and receiver being rigidly connected to the machine frame; and (c) controlling the height of the machine frame relative to the reference location on the ground surface in response to the height measured in step (b); wherein in step (b) the receiver is arranged in a plane extending substantially orthogonal to the reference plane and substantially through the rotating axis of the working drum.

7. A method of controlling a height of a machine frame of a road construction machine relative to a ground surface as the road construction machine moves over the ground surface, comprising:

(a) transmitting with a transmitter at least one measuring beam to define a reference plane, the reference plane extending parallel to one of the machine frame and the ground surface at a reference location;

(b) detecting the at least one measuring beam with a receiver associated with the other of the machine frame and the round surface at the reference location, and thereby measuring the height of the machine frame relative to the reference location on the ground surface, one of the transmitter and receiver being rigidly connected to the machine frame;

(c) controlling the height of the machine frame relative to the reference location on the ground surface in response to the height measured in step (b); and (d) supporting the other of the transmitter and the receiver on a carriage movable synchronously with the machine frame in a direction of travel on the ground surface.

8. The method of claim 7, further comprising:

adjusting a lateral position of the carriage relative to the machine frame.

9. The method of claim 7, further comprising:

at least partially levelling out irregularities of the reference location in the direction of travel by providing the carriage with at least two points of ground engagement spaced in the direction of travel.

10. The method of claim 1, wherein:

in step (a), the transmitter is rigidly connected to the machine frame; and in step (b), the receiver includes a plurality of sensors arranged substantially orthogonal to the reference plane at the reference location, and the sensors measure a distance from the reference plane to the ground surface at the reference location.

11. The method of claim 1, wherein:

in step (b) the receiver is rigidly connected to the machine frame, and the receiver includes a plurality of sensors arranged substantially orthogonal to a frame plane of the machine frame.

12. The method of claim 1, wherein:

in step (b) the receiver includes first and second sensors spaced in a direction of travel; and the method further comprises detecting a slope of a frame plane of the machine frame relative to the ground surface, and controlling a longitudinal inclination of the machine frame.

13. The method of claim 1, wherein:

in step (a) the transmitting further comprises transmitting a linear coherent light beam.

14. The method of claim 1, wherein:

in step (a) the transmitting further comprises transmitting a sector shaped scan of a coherent light beam.

15. The method of claim 14, wherein:

in step (a) the sector shaped scan comprises an angle of up to 360 degrees.

16. The method of claim 1, wherein:

in step (b) the receiver comprises a transparent housing extending to above the reference plane; and in step (a) the measuring beam is transmitted through the transparent housing.

17. The method of claim 1, wherein:

the reference location on the ground surface is located along a road centerline.

18. A method of controlling a height of a machine frame of a road construction machine relative to a ground surface as the road construction machine moves over the ground surface, comprising:

(a) moving the road construction machine in a direction of travel;

(b) supporting the road construction machine from the ground surface with a plurality of ground engaging supports;

(c) adjusting a height of the machine frame from the plurality of ground engaging supports with a plurality of height adjusters;

(d) moving a ground engaging carriage alongside the machine frame;

(e) transmitting at least one measuring beam representative of a reference plane witha transmitter mounted on one of the machine frame and the carriage;

(f) receiving the at least one measuring beam with a receiver mounted on the other of the machine frame and the carriage, and generating a distance signal representative of the height of the machine frame relative to the ground surface; and (g) receiving the distance signal with a controller, and controlling the height adjusters in response to the distance signal.

19. The method of claim 18, wherein:

in step (e), the transmitter is rigidly connected to the machine frame and the reference plane is defined parallel to the machine frame.

20. The method of claim 18, wherein:

in step (e) the reference plane extends parallel to the ground surface at the carriage; and in step (f) the receiver is rigidly connected to the machine frame.

21. The method of claim 18, the machine including a working drum mounted in the machine frame, the working drum having a rotating axis, wherein:

in step (f) the receiver is arranged in a plane extending substantially orthogonal to the reference plane and substantially through the rotating axis of the working drum.

22. The method of claim 18, further comprising:

adjusting a lateral position of the carriage relative to the machine frame.

23. The method of claim 18, further comprising:

at least partially levelling out irregularities of the ground surface in the direction of travel by providing the carriage with at least two points of ground engagement spaced in the direction of travel.

24. The method of claim 18, wherein:

in step (e), the transmitter is rigidly connected to the machine frame; and in step (f), the receiver includes a plurality of sensors arranged substantially orthogonal to the reference plane, and the sensors measure a distance from the reference plane to the ground surface.

25. The method of claim 18, wherein:

in step (f) the receiver is rigidly connected to the machine frame, and the receiver includes a plurality of sensors arranged substantially orthogonal to a frame plane of the machine frame.

26. The method of claim 18, wherein:

in step (f) the receiver includes a first and second sensors spaced in a direction of travel; and the method further comprises detecting a slope of a frame plane of the machine frame relative to the ground surface, and controlling a longitudinal inclination of the machine frame.

27. The method of claim 18, wherein:

in step (e) the transmitting further comprises transmitting a linear coherent light beam.

28. The method of claim 18, wherein:

in step (e) the transmitting further comprises transmitting a sector shaped scan of a coherent light beam, the sector shaped scan comprising an angle of up to 360 degrees.

29. The method of claim 18, wherein:

in step (f) the receiver comprises a transparent housing extending to above the reference plane; and in step (e) the measuring beam is transmitted through the transparent housing.

* * * * *

UNITED STATES PATENT AND TRADEMARK OFFICE

CERTIFICATE OF CORRECTION

PATENT NO. : 9,057,161 B2
APPLICATION NO. : 14/183682
DATED : June 16, 2015
INVENTOR(S) : Berning et al.

It is certified that error appears in the above-identified patent and that said Letters Patent is hereby corrected as shown below:

In the claims

Column 7, line 46, Claim 2, replace “round” with --ground--;
Column 8, line 7, Claim 3, replace “round” with --ground--;
Column 8, line 39, Claim 6, replace “round” with --ground--;
Column 8, line 60, Claim 7, replace “round” with --ground--.

Signed and Sealed this
Twentieth Day of October, 2015

Michelle K. Lee

Michelle K. Lee
*Director of the United States Patent and Trademark Office*